US008590231B2

(12) United States Patent
Pilz

(10) Patent No.: US 8,590,231 B2
(45) Date of Patent: Nov. 26, 2013

(54) FIRE-RATED JOINT SYSTEM

(75) Inventor: Don A. Pilz, Livermore, CA (US)

(73) Assignee: California Expanded Metal Products Company, City of Industry, CA (US)

( * ) Notice: Subject to any disclaimer, the term of this patent is extended or adjusted under 35 U.S.C. 154(b) by 31 days.

(21) Appl. No.: 13/426,314

(22) Filed: Mar. 21, 2012

(65) Prior Publication Data

US 2013/0186020 A1 Jul. 25, 2013

Related U.S. Application Data

(60) Provisional application No. 61/589,188, filed on Jan. 20, 2012.

(51) Int. Cl.
*E04C 2/30* (2006.01)

(52) U.S. Cl.
USPC ..... 52/232; 52/241; 52/481.1

(58) Field of Classification Search
USPC ..... 52/232, 481.1, 483.1, 831, 846, 241, 52/481.2
See application file for complete search history.

(56) References Cited

U.S. PATENT DOCUMENTS

| | | | |
|---|---|---|---|
| 1,130,722 | A | 3/1915 | Fletcher |
| 1,563,651 | A | 12/1925 | Pomerantz |
| 2,218,426 | A | 10/1940 | Hulbert, Jr. |
| 2,683,927 | A | 7/1954 | Maronek |
| 2,733,786 | A | 2/1956 | Drake |
| 3,129,792 | A | 4/1964 | Gwynne |
| 3,324,615 | A | 6/1967 | Zinn |
| 3,397,495 | A | 8/1968 | Thompson |
| 3,481,090 | A | 12/1969 | Lizee |
| 3,537,219 | A | 11/1970 | Navarre |
| 3,566,559 | A | 3/1971 | Dickson |
| 3,744,199 | A | 7/1973 | Navarre |
| 3,786,604 | A | 1/1974 | Kramer |
| 3,839,839 | A | 10/1974 | Tillisch et al. |
| 3,908,328 | A | 9/1975 | Nelsson |
| 3,935,681 | A | 2/1976 | Voiturier et al. |
| 3,955,330 | A | 5/1976 | Wendt |
| 3,964,214 | A | 6/1976 | Wendt |

(Continued)

FOREIGN PATENT DOCUMENTS

| | | |
|---|---|---|
| CA | 2234347 | 10/1999 |
| EP | 0 346 126 | 12/1989 |

(Continued)

OTHER PUBLICATIONS

BlazeFrame 2009 catalog of products, available at least as of Mar. 4, 2010 from www.blazeframe.com, in 20 pages.

(Continued)

*Primary Examiner* — James Buckle, Jr.
(74) *Attorney, Agent, or Firm* — Knobbe Martens Olson & Bear LLP

(57) ABSTRACT

A fire-rated angle piece and wall assemblies or other assemblies that incorporate the fire-rated angle piece, in which the angle piece includes an intumescent or other fire-resistant material strip. The angle can be attached adjacent to a corner of a framing member, such as metal tracks, headers, header tracks, sill plates, bottom tracks, metal studs, wood studs or wall partitions, and placed between the framing member and a wall board member at a perimeter of a wall assembly to create a fire block arrangement.

18 Claims, 8 Drawing Sheets

(56) References Cited

U.S. PATENT DOCUMENTS

| | | | |
|---|---|---|---|
| 3,974,607 | A | 8/1976 | Balinski |
| 4,011,704 | A | 3/1977 | O'Konski |
| 4,103,463 | A | 8/1978 | Dixon |
| 4,130,972 | A | 12/1978 | Varlonga |
| 4,144,335 | A | 3/1979 | Edwards |
| 4,144,385 | A | 3/1979 | Downing |
| 4,152,878 | A | 5/1979 | Balinski |
| 4,164,107 | A | 8/1979 | Kraemling et al. |
| 4,178,728 | A | 12/1979 | Ortmanns et al. |
| 4,203,264 | A | 5/1980 | Kiefer et al. |
| 4,283,892 | A | 8/1981 | Brown |
| 4,318,253 | A | 3/1982 | Wedel |
| 4,329,820 | A | 5/1982 | Wendt |
| 4,424,653 | A | 1/1984 | Heinen |
| 4,437,274 | A | 3/1984 | Slocum et al. |
| 4,649,089 | A | 3/1987 | Thwaites |
| 4,672,785 | A | 6/1987 | Salvo |
| 4,709,517 | A | 12/1987 | Mitchell et al. |
| 4,723,385 | A | 2/1988 | Kallstrom |
| 4,787,767 | A | 11/1988 | Wendt |
| 4,825,610 | A | 5/1989 | Gasteiger |
| 4,850,385 | A | 7/1989 | Harbeke |
| 4,885,884 | A | 12/1989 | Schilger |
| 4,918,761 | A | 4/1990 | Harbeke |
| 4,930,276 | A | 6/1990 | Bawa et al. |
| 5,010,702 | A | 4/1991 | Daw et al. |
| 5,094,780 | A | 3/1992 | von Bonin |
| 5,103,589 | A | 4/1992 | Crawford |
| 5,125,203 | A | 6/1992 | Daw |
| 5,127,203 | A | 7/1992 | Paquette |
| 5,127,760 | A | 7/1992 | Brady |
| 5,146,723 | A | 9/1992 | Greenwood et al. |
| 5,155,957 | A | 10/1992 | Robertson et al. |
| 5,157,883 | A | 10/1992 | Meyer |
| 5,167,876 | A | 12/1992 | Lem |
| 5,173,515 | A | 12/1992 | von Bonin et al. |
| 5,222,335 | A | 6/1993 | Petrecca |
| 5,244,709 | A | 9/1993 | Vanderstukken |
| 5,285,615 | A | 2/1994 | Gilmour |
| 5,325,651 | A | 7/1994 | Meyer et al. |
| 5,347,780 | A | 9/1994 | Richards et al. |
| 5,367,850 | A | 11/1994 | Nicholas |
| 5,374,036 | A | 12/1994 | Rogers et al. |
| 5,390,465 | A | 2/1995 | Rajecki |
| 5,394,665 | A | 3/1995 | Johnson |
| 5,412,919 | A | 5/1995 | Pellock et al. |
| 5,452,551 | A | 9/1995 | Charland et al. |
| 5,456,050 | A | 10/1995 | Ward |
| 5,471,805 | A | 12/1995 | Becker |
| 5,552,185 | A | 9/1996 | De Keyser |
| 5,592,796 | A | 1/1997 | Landers |
| 5,604,024 | A | 2/1997 | von Bonin |
| 5,644,877 | A | 7/1997 | Wood |
| 5,687,538 | A | 11/1997 | Frobosilo et al. |
| 5,689,922 | A | 11/1997 | Daudet |
| 5,709,821 | A | 1/1998 | von Bonin et al. |
| 5,755,066 | A | 5/1998 | Becker |
| 5,787,651 | A | 8/1998 | Horn et al. |
| 5,797,233 | A | 8/1998 | Hascall |
| 5,806,261 | A | 9/1998 | Huebner et al. |
| 5,913,788 | A | 6/1999 | Herren |
| 5,921,041 | A | 7/1999 | Egri, II |
| 5,927,041 | A | 7/1999 | Sedlmeier et al. |
| 5,930,963 | A | 8/1999 | Nichols |
| 5,950,385 | A | 9/1999 | Herren |
| 5,968,669 | A | 10/1999 | Liu et al. |
| 6,058,668 | A | 5/2000 | Herren |
| 6,110,559 | A | 8/2000 | De Keyser |
| 6,151,858 | A | 11/2000 | Ruiz et al. |
| 6,176,053 | B1 | 1/2001 | St. Germain |
| 6,189,277 | B1 | 2/2001 | Boscamp |
| 6,207,077 | B1 | 3/2001 | Burnell-Jones |
| 6,207,085 | B1 | 3/2001 | Ackerman |
| 6,213,679 | B1 | 4/2001 | Frobosilo et al. |
| 6,216,404 | B1 | 4/2001 | Vellrath |
| 6,233,888 | B1 | 5/2001 | Wu |
| 6,305,133 | B1 | 10/2001 | Cornwall |
| 6,374,558 | B1 | 4/2002 | Surowiecki |
| 6,405,502 | B1 | 6/2002 | Cornwall |
| 6,430,881 | B1 | 8/2002 | Daudet et al. |
| 6,470,638 | B1 | 10/2002 | Larson |
| 6,647,691 | B2 | 11/2003 | Becker et al. |
| 6,679,015 | B1 | 1/2004 | Cornwall |
| 6,705,047 | B2 | 3/2004 | Yulkowski |
| 6,732,481 | B2 | 5/2004 | Stahl, Sr. |
| 6,783,345 | B2 | 8/2004 | Morgan et al. |
| 6,799,404 | B2 | 10/2004 | Spransy |
| 6,843,035 | B1 | 1/2005 | Glynn |
| 6,854,237 | B2 | 2/2005 | Surowiecki |
| 6,871,470 | B1 | 3/2005 | Stover |
| 7,043,880 | B2 | 5/2006 | Morgan et al. |
| 7,152,385 | B2 | 12/2006 | Morgan et al. |
| 7,191,845 | B2 | 3/2007 | Loar |
| 7,240,905 | B1 | 7/2007 | Stahl |
| 7,302,776 | B2 | 12/2007 | Duncan et al. |
| 7,506,478 | B2 | 3/2009 | Bobenhausen |
| 7,540,118 | B2 | 6/2009 | Jensen |
| 7,617,643 | B2 | 11/2009 | Pilz et al. |
| 7,681,365 | B2 | 3/2010 | Klein |
| 7,752,817 | B2 | 7/2010 | Pilz et al. |
| 7,775,006 | B2 | 8/2010 | Giannos |
| 7,776,170 | B2 | 8/2010 | Yu et al. |
| 7,814,718 | B2 | 10/2010 | Klein |
| 7,827,738 | B2 | 11/2010 | Abrams et al. |
| 7,866,108 | B2 | 1/2011 | Klein |
| 7,950,198 | B2 | 5/2011 | Pilz et al. |
| 8,056,293 | B2 | 11/2011 | Klein |
| 8,061,099 | B2 | 11/2011 | Andrews |
| 8,074,416 | B2 | 12/2011 | Andrews |
| 8,087,205 | B2 | 1/2012 | Pilz et al. |
| 8,132,376 | B2 | 3/2012 | Pilz et al. |
| 8,136,314 | B2 | 3/2012 | Klein |
| 8,151,526 | B2 | 4/2012 | Klein |
| 8,181,404 | B2 | 5/2012 | Klein |
| 8,225,581 | B2 | 7/2012 | Strickland et al. |
| 8,281,552 | B2 | 10/2012 | Pilz et al. |
| 8,322,094 | B2 | 12/2012 | Pilz et al. |
| 8,353,139 | B2 | 1/2013 | Pilz |
| 2002/0170249 | A1 | 11/2002 | Yulkowski |
| 2003/0079425 | A1 | 5/2003 | Morgan et al. |
| 2003/0089062 | A1 | 5/2003 | Morgan et al. |
| 2003/0213211 | A1 | 11/2003 | Morgan et al. |
| 2004/0010998 | A1 | 1/2004 | Turco |
| 2004/0045234 | A1 | 3/2004 | Morgan et al. |
| 2004/0139684 | A1 | 7/2004 | Menendez |
| 2004/0211150 | A1 | 10/2004 | Bobenhausen |
| 2005/0183361 | A1 | 8/2005 | Frezza |
| 2005/0246973 | A1 | 11/2005 | Jensen |
| 2006/0032163 | A1 | 2/2006 | Korn |
| 2006/0123723 | A1 | 6/2006 | Weir et al. |
| 2006/0137293 | A1* | 6/2006 | Klein ..... 52/782.1 |
| 2007/0056245 | A1 | 3/2007 | Edmondson |
| 2007/0068101 | A1 | 3/2007 | Weir et al. |
| 2007/0193202 | A1 | 8/2007 | Rice |
| 2007/0261343 | A1 | 11/2007 | Stahl, Sr. |
| 2008/0087366 | A1 | 4/2008 | Yu et al. |
| 2008/0134589 | A1 | 6/2008 | Abrams et al. |
| 2008/0172967 | A1 | 7/2008 | Hilburn |
| 2008/0250738 | A1 | 10/2008 | Howchin |
| 2009/0178369 | A1 | 7/2009 | Pilz et al. |
| 2010/0126092 | A1* | 5/2010 | Pilz et al. ..... 52/232 |
| 2011/0099928 | A1 | 5/2011 | Klein et al. |
| 2011/0167742 | A1 | 7/2011 | Klein |
| 2011/0185656 | A1 | 8/2011 | Klein |
| 2011/0214371 | A1 | 9/2011 | Klein |
| 2011/0247281 | A1 | 10/2011 | Pilz et al. |
| 2012/0066989 | A1 | 3/2012 | Pilz et al. |
| 2012/0297710 | A1 | 11/2012 | Klein |
| 2013/0031856 | A1 | 2/2013 | Pilz et al. |

FOREIGN PATENT DOCUMENTS

| | | |
|---|---|---|
| GB | 2 159 051 | 11/1985 |
| GB | 2 411 212 | 8/2005 |

(56) References Cited

FOREIGN PATENT DOCUMENTS

| | | |
|---|---|---|
| JP | 06-146433 | 5/1994 |
| JP | 06-220934 | 8/1994 |
| WO | WO 03/038206 | 5/2003 |
| WO | WO 2007/103331 | 9/2007 |
| WO | WO 2009/026464 | 2/2009 |

OTHER PUBLICATIONS

International Search Report for Application No. PCT/US2008/073920, dated Apr. 9, 2009.

* cited by examiner

FIRE-RATED JOINT SYSTEM

RELATED APPLICATIONS

Related applications are listed in an Application Data Sheet (ADS) filed with this application. All applications listed in the ADS are hereby incorporated by reference herein in their entireties.

BACKGROUND OF THE INVENTION

1. Field of the Invention

The present invention generally relates to fire-rated building structures. In particular, the present invention relates to fire-rated joint systems and wall assemblies, and other building structures, incorporating the fire-rated joint systems.

2. Description of the Related Art

Fire-rated construction components and assemblies are also commonly used in the construction industry. These components and assemblies are aimed at preventing fire, heat, and smoke from leaving one room or other portion of a building and entering another room or portion of a building. The fire, heat or smoke usually moves between rooms through vents, joints in walls, or other openings. The fire-rated components often incorporate fire-retardant materials which substantially block the path of the fire, heat or smoke for at least some period of time. Intumescent materials work well for this purpose, since they swell and char when exposed to flames, helping to create a barrier to the fire, heat, and/or smoke.

One particular wall joint with a high potential for allowing fire, heat or smoke to pass from one room to another is the joint between the top of a wall and the ceiling, which can be referred to as a head-of-wall joint. In modern multi-story or multi-level buildings, the head-of-wall joint is often a dynamic joint in which relative movement between the ceiling and the wall is permitted. This relative movement is configured to accommodate deflection in the building due to loading of the ceiling or seismic forces. The conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages that are described herein.

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

Header tracks generally have a web and at least one flange extending from the web. Typically, the header track includes a pair of flanges, which extend in the same direction from opposing edges of the web. The header track can be slotted header track, which includes a plurality of slots spaced along the length of the track and extending in a vertical direction. When the wall studs are placed into the slotted track, each of the plurality of slots accommodates a fastener used to connect the wall stud to the slotted track. The slots allow the wall studs to move generally orthogonally relative to the track. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads, as described above.

Recently, improved methods of providing a fire-rated head-of-wall joint have been developed. One example of a fire-rated wall construction component is a head-of-wall fire block device sold by the Assignee of the present application under the trademark FireStik®. The FireStik® fire block product incorporates a metal profile with a layer of intumescent material on its inner surface. The metal profile of the FireStik® fire block product is independently and rigidly attached to a wall component, such as the bottom of a floor or ceiling, and placed adjacent to the gap between the wallboard (e.g., drywall) and the ceiling on the opposite side (i.e., outside) of the wallboard relative to the studs and header track. The intumescent material, which is adhered to the inner surface of the metal profile, faces the wallboard, stud and header track. The space created in between the wallboard and ceiling, and the space between the stud and header track, allows for independent vertical movement of the stud in the header track when no fire is present.

When temperatures rise, the intumescent material on the FireStik® fire block product expands rapidly and chars. This expansion creates a barrier which fills the head-of-wall gap and inhibits or at least substantially prevents fire, heat and smoke from moving through the head-of-wall joint and entering an adjacent room for at least some period of time.

Still another example of an improved construction component for creating a fire-rated head-of-wall joint is a header track with integrated intumescent material strips sold by the Assignee of the present application under the trademark FAS Track®. In contrast to the FireStik® fire block product, the FAS Track® header track product incorporates the intumescent material directly on the header track so that the fire block material is installed during the framing process. Both the FireStik® and the FAS Track® fire block products are typically installed by the framing crew. The integration of the intumescent material into the FAS Track® header track product eliminates the need to install an additional fire block product after the wall board has been installed.

SUMMARY OF THE INVENTION

Although the FireStik® and the FAS Track® products represent an improvement over the conventional method of stuffing mineral wool material into the head-of-wall joint and applying the elastomeric spray material over the mineral wool, there still exists room for improved products and methods for efficiently and cost-effectively creating fire-rated wall joints. Certain embodiments of the present invention involve a fire-rated angle piece that incorporates a fire-resistant or intumescent material on one, and preferably more than one, surface of the angle piece. The angle piece is separate from the header track, but is configured to be installed prior to the installation of the wall board and, preferably, during the framing process. Advantageously, the present angle piece can be installed along with the installation of the header track or can be installed after the installation of the header track. Such an arrangement avoids the need to have the framers return after the installation of the wall board. In addition, the angle piece can be stacked and shipped without damaging the intumescent material more easily than a header track that incorporates the intumescent material.

An embodiment involves a fire-rated assembly for a linear wall gap. The assembly includes a track that has a web, a first flange and a second flange. The web is substantially planar and has a first side edge and a second side edge. The first flange and the second flange extend in the same direction from the first and second side edges, respectively. Each of the first and second flanges is substantially planar such that the track defines a substantially U-shaped cross-section. An angle has a first flange and a second flange. Each of the first flange and the second flange is substantially planar such that the angle defines a substantially L-shaped cross-section. Each of the first and second flanges has a free end opposite a corner of the angle. A heat-expandable intumescent strip is attached to the angle and extends lengthwise along an outer surface of the second flange. The intumescent strip comprising a portion that extends past an outer surface of the first flange of the angle. The first flange of the angle is positioned between the web of the track and an overhead structure with the second flange of the angle being positioned adjacent one of the first or second flanges of the track with at least a portion of the second flange contacting the one of the first or second flanges of the track.

Another embodiment involves a fire-rated wall joint product and wall or other assemblies incorporating the fire-rated wall joint product. The fire-rated wall joint product includes an elongated, generally L-shaped angle piece and an intumescent material strip. The angle piece includes a first flange and a second flange oriented at an angle relative to the first flange. The first flange and the second flange each have a free edge and are connected to one another along an edge that is opposite the free edge. The first flange and second flange are formed from a single piece of material. The angle between the first flange and the second flange is equal to or greater than about 80 degrees and less than 90 degrees. Preferably, the angle is about 87 degrees. The intumescent material strip is applied to the angle piece such that a portion of the intumescent material strip is located on each of the first flange and the second flange.

Another embodiment involves a method of assembling a fire-rated wall joint. The method includes securing a header track to a ceiling, positioning a horizontal leg of an elongated, generally L-shaped fire-rated angle piece between the header track and the ceiling such that at least a portion of an intumescent material strip located on a vertical leg of the angle piece faces away from the header track, positioning upper ends of a plurality of studs into the header track, and securing at least one wall board member to the plurality of studs such that the vertical leg of the angle piece is positioned between the at least one wall board member and the header track.

BRIEF DESCRIPTION OF THE DRAWINGS

Certain features, aspects and advantages of the various devices, systems and methods presented herein are described with reference to drawings of certain embodiments, which are intended to illustrate, but not to limit, such devices, systems, and methods. It is to be understood that the drawings are for the purpose of illustrating concepts of the embodiments discussed herein and may not be to scale. For example, certain gaps or spaces between components illustrated herein may be exaggerated to assist in the understanding of the embodiments. Dimensions, if provided in the specification, are merely for the purpose of example in the context of the specific arrangements shown and are not intended to limit the disclosure. The drawings contain sixteen (16) figures.

In FIG. 10, the head-of-wall assembly is shown in a closed or upward position.

DETAILED DESCRIPTION OF THE PREFERRED EMBODIMENTS

Several preferred embodiments of the fire-rated angle pieces and fire-rated joint systems are described herein, typically in the context of a wall assembly and, in particular, a head-of-wall assembly. However, the fire-rated angle pieces and fire-rated joint systems can also be used in other applications, such as at the bottom or sides of a wall or a joint in an intermediate location of a wall. The fire-rated angle pieces and fire-rated joint systems can also be used in non-wall applications. In view of the head-of-wall assembly being but one of the multiple applications for the fire-rated angle pieces and fire-rated joint systems, the use of relative or directional terminology, or other such descriptions, is for convenience in describing the particular embodiments, arrangements or orientations shown. Therefore, such terms are not intended to be limiting, unless specifically designated as such.

Figure 1:
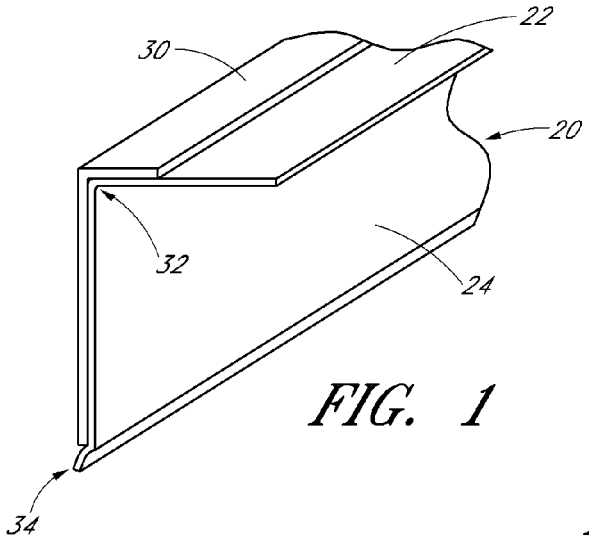
FIG. 1 is a perspective view of a fire-rated angle piece, which incorporates a fire-resistant or intumescent material strip.
Figure 2:
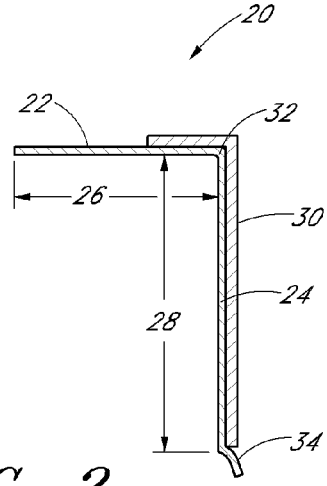
FIG. 2 is a cross-sectional view of the fire-rated angle piece of FIG. 1.
Figure 3:
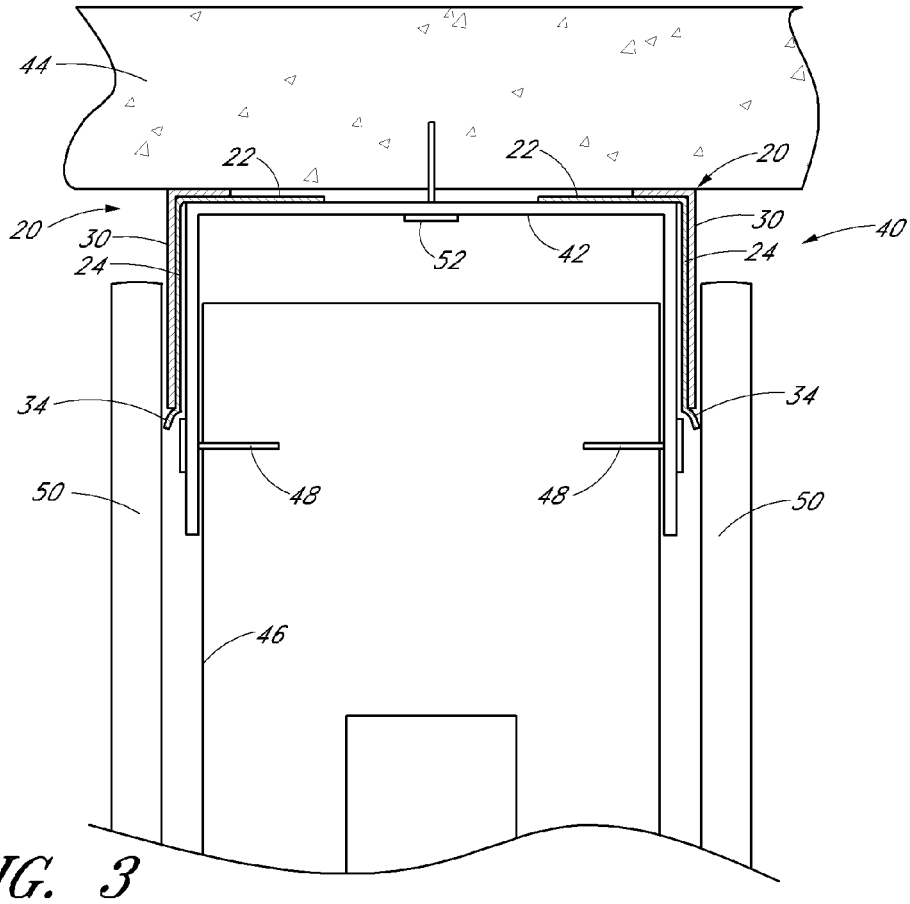
FIG. 3 is a cross-sectional view of a head-of-wall joint incorporating the fire-rated angle piece of FIG. 1.

FIGS. 1-3 illustrate an embodiment of a fire-rated profile or angle piece 20, which is also referred to herein simply as an angle 20, alone (FIGS. 1 and 2) and incorporated into a head-of-wall assembly (FIG. 3). The angle 20 preferably is formed from a light gauge steel material by any suitable process, such as roll forming, for example. Preferably, the angle 20 is an elongated member having a consistent or substantially consistent cross-sectional shape throughout its length. One or more preferred embodiments of the angle 20 are generally or substantially L-shaped in cross-section. In one embodiment, the angle 20 may be between about 5 feet and 25 feet in length. The angle 20 can be between about 10 and 20 feet in length. Preferably, the angle 20 is about 10-12 feet in length to facilitate shipping and storage. Desirably, the angle 20 is sufficiently long to allow installation along a wall with a relatively small number of pieces. However, the length of the angle 20 should be short enough that shipping and material handling is relatively convenient. Accordingly, the above-recited lengths are presently preferred. However, other lengths may also be used in other situations.

Preferably, the angle 20 includes a top or upper wall portion or top or upper leg or flange 22. The upper wall portion 22 is also referred to herein as a horizontal leg because it is typically oriented in a horizontal or substantially horizontal plane when installed in a head-of-wall assembly, as described herein. The angle 20 also includes a side wall portion 24, which is also referred to herein as a vertical leg or flange because it is typically oriented in a vertical or substantially vertical plane when the angle 20 is installed in a head-of-wall assembly. The illustrated vertical leg 24 is unitarily formed with the horizontal leg 22. That is, the horizontal leg 22 and the vertical leg 24 are constructed from a single piece of material. As described above, typically, the single piece of material is a flat piece of light gauge steel, which is then deformed into the shape of the angle 20, such as through a roll-forming or other suitable process. Preferably, both the horizontal leg 22 and the vertical leg 24 are substantially planar and define an angle therebetween of about 90 degrees or, in some arrangements, slightly less than 90 degrees. For example, the legs 22 and 24 may define an angle of between about 80 degrees and about 90 degrees, between about 85 degrees and 90 degrees or about 87 degrees. This can assist in providing a gap at the upper end of the vertical leg 24 to accommodate a fastener head, as is described in greater detail below.

In one embodiment of the light gauge steel angle 20, the horizontal leg 22 can define a width 26 (i.e., horizontal cross-sectional dimension) of about ¾ inch or less, 1 inch or less, or 1½ inches or less. Preferably, the horizontal leg 22 is about 1½ inches wide. The vertical leg 24 can define a width or height 28 (i.e., vertical cross-sectional dimension) between about ½ inch and about 3 inches or more depending on amount of fire and smoke protection desired and/or based on deflection requirements. The dimensions of the width of the horizontal leg 22 preferably are selected such that two angles 20 can be employed in a head-of-wall assembly (illustrated in FIG. 3) with one angle 20 on each side of the wall. Preferably, the width of the horizontal leg 22 is selected such that the legs 22 of the two angles 20 do not overlap one another when assembled into the head-of-wall assembly. Accordingly, if the angle 20 is configured for use with a wall assembly that is wider than standard width, the width of the horizontal leg 22 can be increased to, for example, about 1½ inches to about 3 inches, or more. The width or height of the vertical leg 24 is selected such that the leg 24 fills the entire head-of-wall gap, or gap between the ceiling and upper end surfaces of the wall board, in an open-most position of the head-of-wall joint (assuming a dynamic joint). Alternatively, the width or height of the vertical leg 24 is selected to cover a substantial portion, such as ⅓ to ½ or more, of the corresponding leg of the header track. Thus, the actual width or height of the vertical leg 24 can vary from the exemplary widths or heights described herein.

Preferably, a fire retardant material or a fire retardant material strip, such as an intumescent tape or intumescent strip 30, is adhesively (or otherwise) applied to the full length of the fire-rated angle 20. In a preferred arrangement, the intumescent tape 30 wraps over the corner 32 of the angle 20 (intersection between the horizontal leg 22 and the vertical leg 24) and is positioned on each of the horizontal leg 22 and vertical leg 24. Preferably, the intumescent tape 30 extends only partially across the horizontal leg 22 and extends substantially or entirely across the vertical leg 24. Preferably, the intumescent tape 30 extends less than halfway or about ⅓ of the way across the horizontal leg 22. In other arrangements, the intumescent tape 30 can extend all the way across the horizontal leg 22 and/or only partially across the vertical leg 24. However, preferably, at least a portion of the intumescent tape 30 is located on the horizontal leg 22. Such an arrangement results in the intumescent tape 30 being sandwiched, pinched or compressed between the header track/horizontal leg 22 and the ceiling thereby keeping the intumescent tape 30 in place in the event of elevated heat or fire. Although heat-resistant adhesive preferably is used to affix the intumescent tape 30 to the angle 20, the adhesive can still fail at temperatures lower than that required to cause expansion of the intumescent tape 30. By pinching the intumescent tape 30 between the ceiling and the angle 20/header track, the intumescent tape 30 is held in place even if the adhesive fails.

Preferably, as described above, the intumescent tape or strip 30 is constructed with a material that expands in response to elevated heat or fire to create a fire-blocking char. One suitable material is marketed as BlazeSeal™ from Rectorseal of Houston, Tex. Other suitable intumescent materials are available from 3M Corporation, Hilti Corporation, Specified Technologies, Inc., or Grace Construction Products. The intumescent material expands to many times (e.g., up to 35 times or more) its original size when exposed to sufficient heat (e.g., 350 degrees Fahrenheit). Thus, intumescent materials are commonly used as a fire block because the expanding material tends to fill gaps. Once expanded, the intumescent material is resistant to smoke, heat and fire and inhibits fire from passing through the head-of-wall joint or other wall joint. Thus, intumescent materials are preferred for many applications. However, other fire retardant materials can also be used. Therefore, the term intumescent strip 30 is used for convenience in the present specification and that the term is to be interpreted to cover other expandable or non-expandable fire-resistant materials as well, such as intumescent paints (e.g., spray-on), fiberglass wool (preferably with a binder, such as cured urea-phenolic resin) or fire-rated dry mix products, unless otherwise indicated. The intumescent strip 30 can have any suitable thickness that provides a sufficient volume of intumescent material to create an effective fire block for the particular application, while having small enough dimensions to be accommodated in a wall assembly. That is, preferably, the intumescent material strips 30 do not cause unsightly protrusions or humps in the wall from excessive build-up of material. In one arrangement, the thickness of the intumescent strip 30 is between about 1/16 (0.0625) inches and ⅛ (0.125) inches, or between about 0.065 inches and 0.090 inches. One preferred thickness is about 0.075 inches.

An optional kick-out 34 extending from a free end of the vertical leg 24 allows the framing screw to cycle under the angle 20 and also provides some protection to the intumescent strip 30, as is described in greater detail below. Preferably, the kick-out 34 extends in the direction of the intumescent strip 30 and in a direction opposite the horizontal leg 22. The kick-out 34 preferably is also unitary with the vertical leg 24 and horizontal leg 22 (i.e., constructed from a single piece of material). The illustrated kick-out 34 is arcuate in shape. Preferably, the kick-out 34 defines an arc of about 90 degrees or about ¼ of a circle. However, the kick-out 34 may define a variable radius, rather than a single radius. The kick-out 34 preferably extends outwardly from an outer surface of the vertical leg 24 by a distance substantially equal to or greater than the thickness of the intumescent tape 30.

FIG. 3 illustrates a wall assembly 40 (in particular, a head-of-wall assembly) including an embodiment of the angle 20 installed on each side of a header track 42. The intumescent strip 30 on the angle 20 is compressed between the header track 42 and an overhead structure/ceiling 44 creating a gasket to protect against smoke, fire and sound passing through the gap between the header track 42 and the ceiling 44. In the illustrated arrangement, the ceiling 44 is a concrete deck. However, the angle 20 can be employed with other types of overhead structures, including a fluted pan deck, which is disclosed herein with reference to FIGS. 12 and 13. The wall assembly 40 also includes a plurality of wall studs 46 (only one is shown), which are coupled to the header track 42 by suitable fasteners 48 (e.g., ½ inch framing screws). The header track 42 can be a slotted header track, which allows vertical movement of the wall studs 46 relative to the header track 42. Wall board members 50 (e.g., drywall) are coupled to the wall studs 46 by suitable fasteners (not shown) and, thus, can move along with the wall studs 46 relative to the header track 42. The wall board 50 is pressed up against the kick-out 34 to provide a continuous seal against smoke and sound passing through the gap between the header track 42/angle 20 and the wall board 50.

The header track 42 is secured to the ceiling 44 by a suitable fastener 52 (e.g., concrete fastener). If the wall assembly 40 includes a dynamic head-of-wall, a gap may be present between upper ends of the wall studs 46 and wall board 50 to allow relative movement therebetween, as shown. The horizontal leg 22 of each angle 20 is interposed between the web of the header track 42 and the ceiling 44 such that the angles 20 are held in place by the header track 42. Compression of the portion of the intumescent strip 30 positioned on the horizontal leg 22 can assist in securing the angle 20 between the header track 42 and the ceiling 44 and inhibiting or preventing undesired removal of the angle 20. The vertical leg 24 of the angle 20 is interposed between the side leg of the header track 42 and the wall board 50. That is, the vertical leg 24 of the angle 20 is positioned on the inside of the wall board 50, which provides an attractive finished head-of-wall joint. As described, the kick-out 34 (if present) can contact the wall board 50 to provide a seal. In addition, the kick-out 34 can facilitate entry of the head portion of the fasteners 48 into the gap between the vertical leg 24 and the side leg of the header track 42 during cycling of the wall studs 46 and wall board 50 relative to the header track 42.

Advantageously, such an arrangement permits the use of a separate component (i.e., the angle 20) to carry the intumescent strip 30 instead of the intumescent strip 30 being placed directly on the header track 42 and also permits the angle 20 to be placed inside the wall board 50. The use of a separate component (angle 20) to carry the intumescent strip 30 can be advantageous because shipping and storage of the angle 20 without damaging the intumescent strip 30 is simplified relative to when the intumescent strip 30 is carried by the header track 42. For example, the angles 20 can be easily stacked and shipped in a box, whereas it is more difficult to stack and ship a header track 42 incorporating intumescent strip(s) 30. In addition, the use of a separate component (angle 20) to carry the intumescent strip 30 allows a fire-rated head-of-wall joint to be created with nearly any type or brand of header track 42 (or other components).

Figure 10:
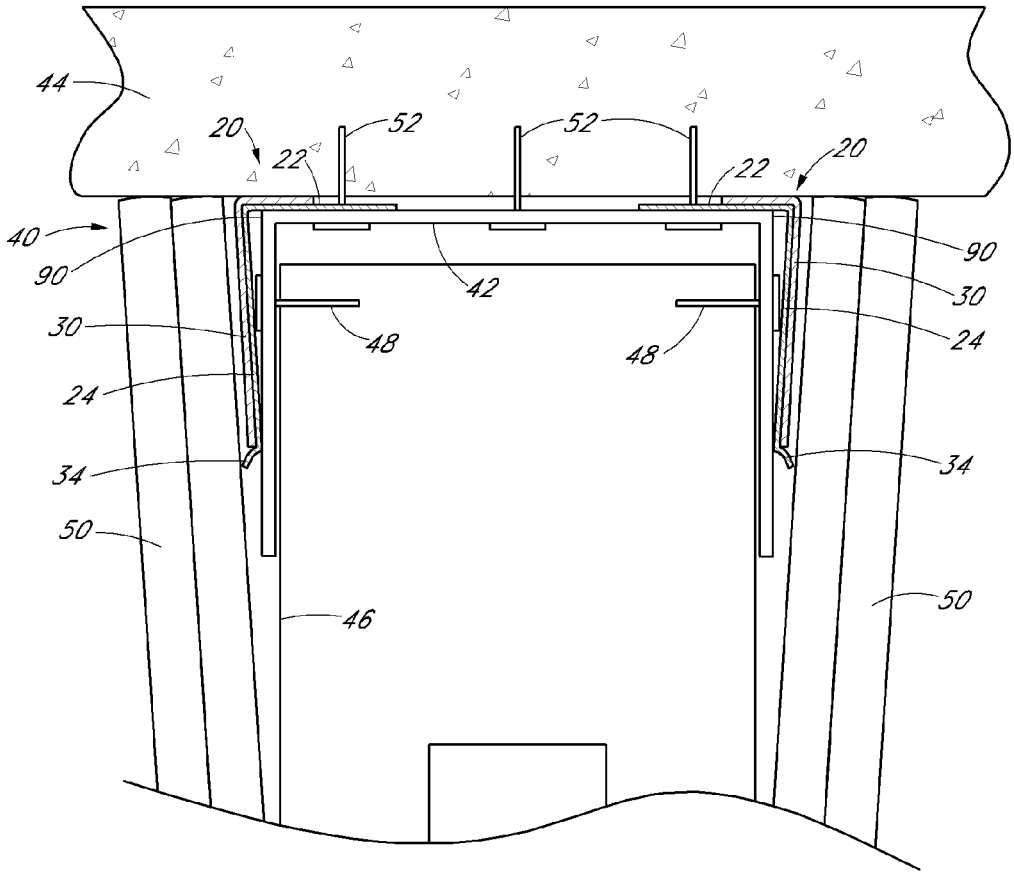
FIG. 10 is a cross-sectional view of a head-of-wall assembly incorporating another embodiment of the fire-rated angle piece.
Figure 11:
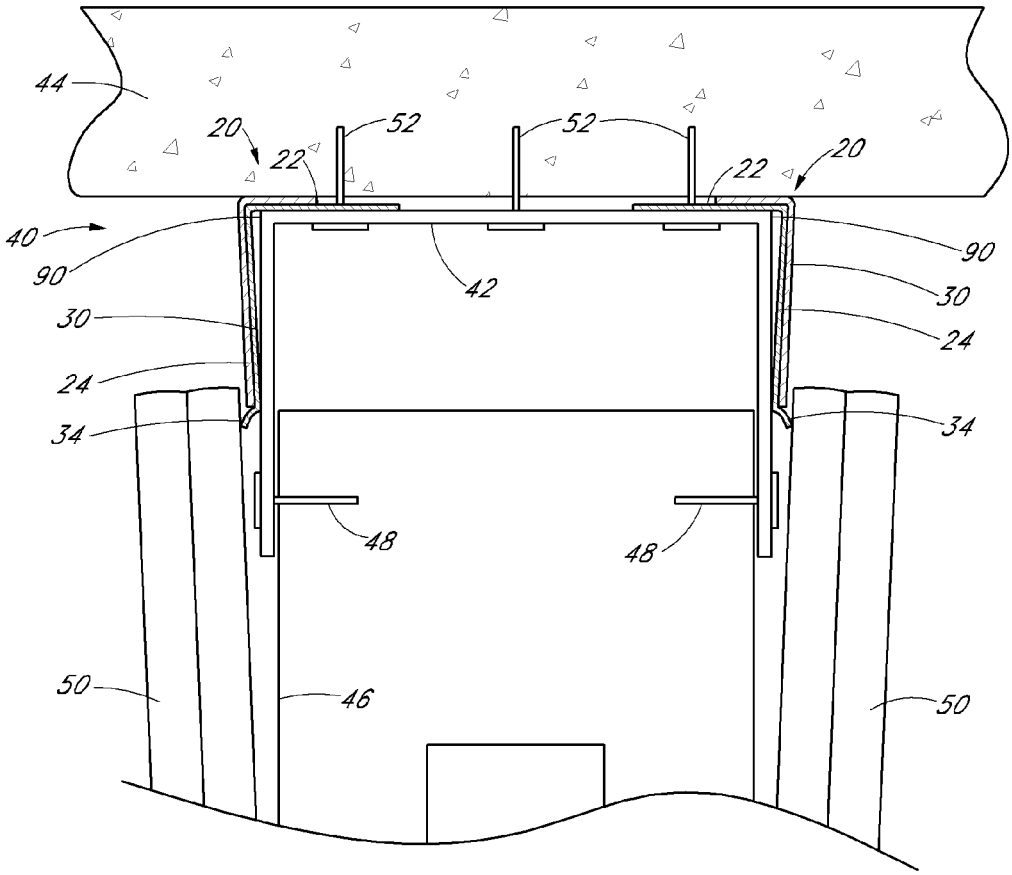
FIG. 11 is a cross-sectional view of the head-of-wall assembly of FIG. 10 in an open or downward position.

The angle(s) 20 can be installed before, during or after installation of the header track 42. If separate fasteners or fastening methods are used, the angle(s) 20 could be affixed to the ceiling 44 separately and prior to the installation of the header track 42. However, preferably, the angle(s) 20 is/are installed during or after installation of the header track 42. The angle(s) 20 can be placed on the header track 42 and then held in place against the ceiling 44 as the header track 42 is secured to the ceiling 44. Alternatively, the angle(s) 20 can be affixed to the header track 42, even if temporarily (e.g., using an adhesive or caulk), and then the header and angle(s) 20 can be secured to the ceiling 44. Or, the angle(s) 20 can be installed after the header track 42 is partially or completely installed. For example, the header track 42 can be secured to the ceiling 44 with a minimum number of fasteners 52, the angle(s) 20 installed, and then the remaining fasteners 52 can be installed to secure the header track 42 to the ceiling 44. Alternatively, the header track 42 can be completely installed and then the angle(s) 20 can be inserted between the header track 42 and the ceiling. The edges of the header track 42 can be slightly flexed to allow insertion of the horizontal leg 22 of the angle 20. The angle(s) 20 can be lightly tapped or otherwise pressed into place. If desired, a spacer (e.g., washer or embossment on the upper surface of the track 42) can be positioned between the ceiling 44 and the header track 42 to create a small gap (preferably smaller than the combined thickness of the horizontal leg 22 and intumescent strip 30) to facilitate insertion of the angle(s) 20. Additional fasteners 52 can be installed through both the header track 42 and angle 20, if desired, as shown in FIGS. 10 and 11.

In the event of elevated heat or a fire, once a threshold heat has been reached, the intumescent strip 30 will rapidly expand to fill any gap present at the head-of-wall, such as between the header track 42 and the ceiling 44 and/or between the angle 20/header track 42 and the wall board 50. The pinching of the intumescent strip 30 between the ceiling and the angle 20/header track 42 assists in keeping the intumescent strip 30 in place when or if the adhesive used to secure the strip 30 to the angle 20 degrades to the point that it is no longer effective. Thus, the illustrated wall assembly 40 provides a reliable fire-rated head-of-wall joint.

Figure 4:
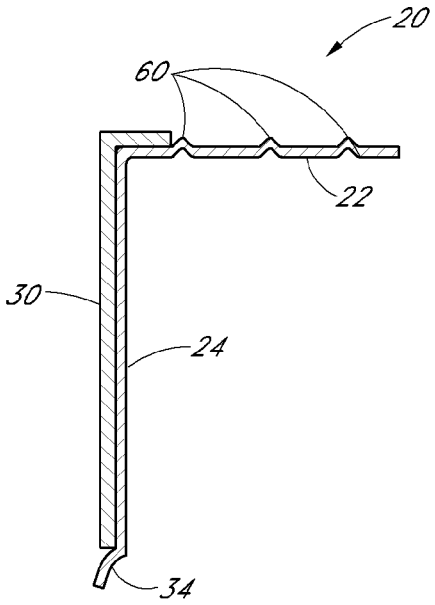
FIG. 4 is a cross-sectional view of an alternative fire-rated angle piece that includes a retention feature on an upper wall portion of the angle piece.
Figure 5:
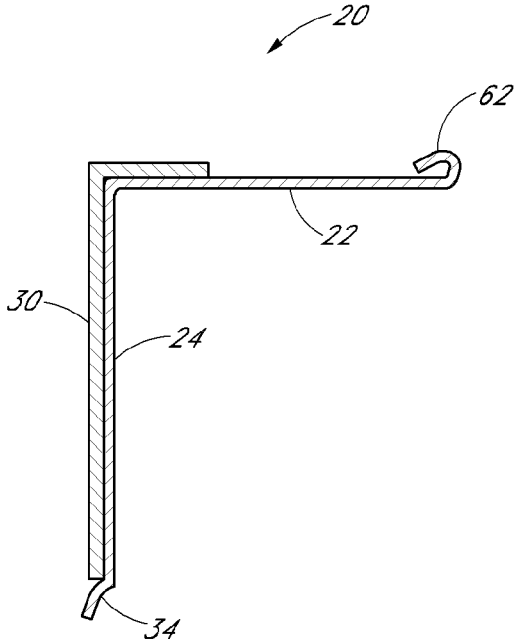
FIG. 5 is a cross-sectional view of another alternative fire-rated angle piece that includes another retention feature, in the form of a hem, on the upper wall portion of the angle piece.
Figure 6:
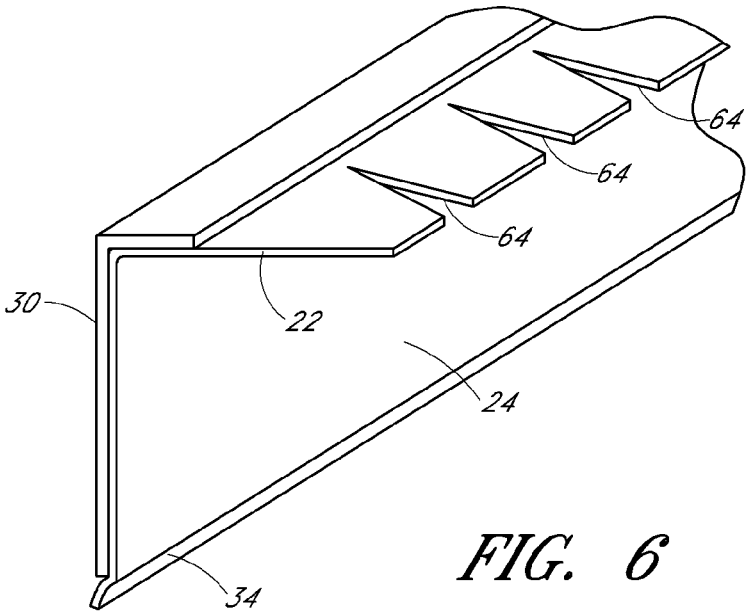
FIG. 6 is a perspective view of another fire-rated angle piece that incorporates notches or slots in the upper wall portion to allow bending of the angle piece or accommodate fasteners used to secure the header track to the ceiling.

With additional reference to FIGS. 4-6, the top horizontal leg 22 of the angle 20 can be made in different styles to provide a way to secure the leg 22 between the header track 42 and the ceiling 44 and inhibiting or preventing inadvertent or undesired removal of the angle 20. As discussed above, the angle 20 illustrated in FIGS. 1-3, which includes planar or flat steel legs 22, 24 will just rely on the compression of the intumescent strip 30 between the angle 20 and the overhead structure 44 or just the compression/friction of the horizontal leg 22 of the angle 20 between the track 42 and the ceiling 44, for example, if the intumescent strip 30 does not wrap onto the horizontal leg 22. With reference to FIG. 4, the top leg 22 can be formed (e.g., embossed) with a retention features, such as raised or interference surface features. In particular, the interference surface features may be provided in the form of protrusions or dimples 60 that serve to increase the friction between the angle 20 and the ceiling 44 and/or create interference contact between the protrusions 60 and imperfections in the ceiling 44. In any event, the force required to remove the angle 20 (the "removal force") can be increased. The raised or interference surface features, protrusions or dimples can be of any suitable shape, preferably which is capable of being created during a roll forming process. To the extent that the protrusions/dimples 60 have a longer dimension in one direction than other directions, the longer dimension preferably extends partially or entirely in a lengthwise direction to increase the dimension tending to resist movement of the angle 20 away from the header track 42 (substantially perpendicular to the wall). The protrusions/dimples 60 preferably have a height that is less than the thickness of the intumescent strip 30 such that they do not prevent a good seal between the intumescent strip 30 and the ceiling 44. However, in other arrangements, the protrusion/dimples 60 can be used to create a seal, especially if configured to extend the entire length of the angle 20, and can extend above the upper surface of the intumescent strip 30.

With reference to FIG. 5, the top leg 22 of the angle 20 can have a small hem 62 so that the angle 20 can be pushed into place and once properly installed the hem 62 inhibits or prevents the angle 20 from being removed or slipping out due to structure vibrations or movement. As shown, preferably, the hem 62 is a fold in the free end of the horizontal leg 22 that is positioned above the remaining, preferably planar, portion of the horizontal leg 22. Preferably, the hem 62 is substantially completed folded over; however, in other arrangements, the hem 62 may be a partial fold similar to the kick-out 34, for example.

With reference to FIG. 6, the upper leg 22 can include slots, cut-outs or notches 64 extending from a free end of the leg 22. In one arrangement, the notches 64 are substantially V-shaped (referred to herein as a V-Cut pattern and individually as V-Cuts). The V-Cut pattern 64 allows the angle 20 to be flexible so that it could be used on radius walls. The V-Cut pattern 64 would also help get around any fasteners 52 that are installed to hold the header track 42 in place that may be close to the outer edge. Features shown in and described with reference to FIGS. 4-6 can be combined with one another and/or incorporated with the other angles 20 described herein.

Figure 9:
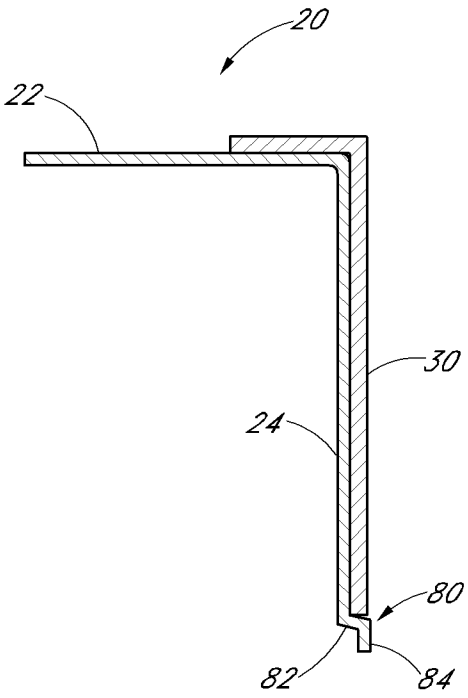
FIG. 9 is a cross-sectional view of another fire-rated angle piece that includes yet another alternative configuration of the free end of the side wall portion.
Figure 8:
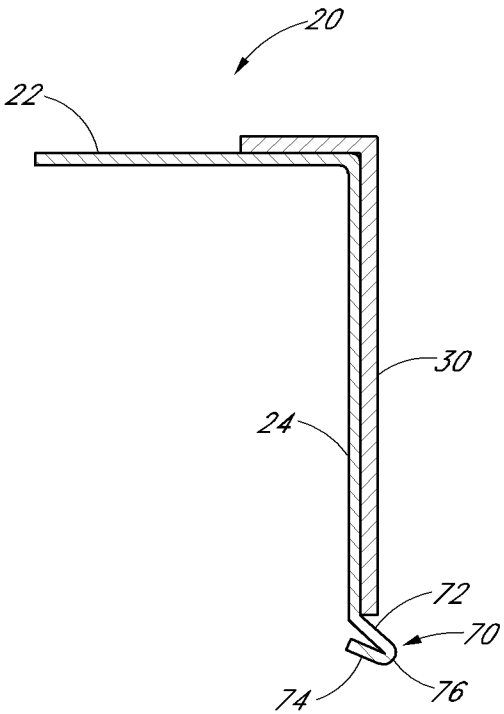
FIG. 8 is a cross-sectional view of another fire-rated angle piece that includes an alternative configuration of a free end of a side wall portion of the angle piece.
Figure 7:
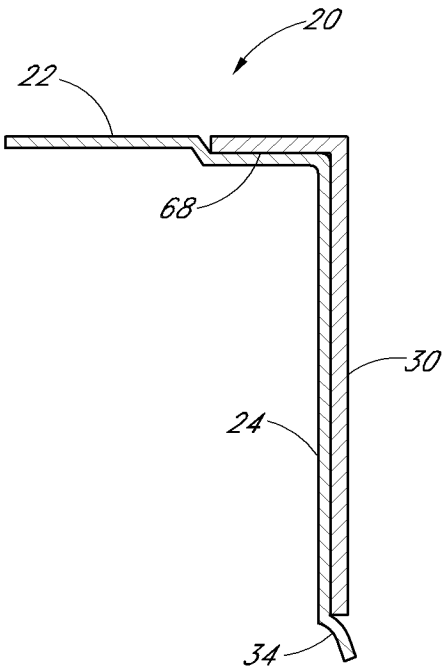
FIG. 7 is a cross-sectional view of another fire-rated angle piece that includes a recess defined in the upper wall portion to accommodate the intumescent material.

With reference to FIGS. 7-9, the kick-out 34 of the vertical leg 24 can be done in different styles. For example, with reference to FIG. 7, a quarter-round pattern provides an open end in which the screw 48 can cycle under the angle 20, as described above. In addition, as shown in FIG. 7, the horizontal leg 22 of the angle 20 may not be completely flat or planar. Rather, in the illustrated arrangement, the leg 22 defines a recessed portion or recess 68 configured to receive the portion of the intumescent strip 30 positioned on the horizontal leg 22. Preferably, the recess 68 is sized and shaped such that the upper surface of the intumescent strip 30 is positioned above the upper surface of the adjacent portion of the horizontal leg 22 such that a good seal is created with the ceiling 44. However, in other arrangements, the upper surface of the intumescent strip 30 can be flush with or positioned below the upper surface of the adjacent portion of the horizontal leg 22.

With reference to FIG. 8, the kick-out is in the form of a small hem 70 provided on the free end of the vertical leg 24 and includes a first or outwardly extending portion 72 and a second or return portion 74. The first portion 72 is angled downward from the remaining upper portion of the vertical leg 24. The return portion 74 extends back toward the inside of the angle 20, but preferably is either aligned with or stops short of the inner surface (extension of the inner surface) of the vertical leg 24 such that interference with the head of the fastener 48 is inhibited or eliminated. Thus, the length of the return portion 74 is preferably less than the length of the outwardly extending portion 72. The intersection of the first and second portions 72, 74 define a corner or rounded surface portion 76 that can contact the wall board 50 to create a seal. Preferably, the corner 76 is positioned outwardly of the outer surface of the intumescent strip 30 to provide protection to the strip 30 during cycling of the wall board 50. However, in other arrangements, the intumescent strip 30 may extend outwardly beyond the corner 76. Similar to the kick-out 34 described with reference to FIGS. 1-7, the hem 70 also provides an open end for the framing screw 48 to cycle.

With reference to FIG. 9, the kick-out is in the form of a block-out 80. The block-out 80 includes a first portion 82 that extends approximately 90 degrees outward from the remaining upper portion of the vertical leg 24 and a second portion 84 that extends approximately 90 degrees downward from the first portion 82. The block-out 80 can also provide an open end for the screw 48 to cycle. Preferably, the outer surface of the block-out 80 is positioned outwardly of the outer surface of the intumescent strip 30 to protection the strip 30 during cycling of the wall board 50. However, the intumescent strip 30 could also extend outwardly of the block-out 80. Features illustrated in and described with reference to FIGS. 7-9 can be incorporated in other embodiments and versions of the angle 20 described herein.

FIGS. 10 and 11 illustrate a head-of-wall assembly 40 similar to that shown in and described with reference to FIG. 3 in which a metal stud framed wall is attached to a solid concrete deck. Accordingly, the same reference numbers are used to describe the same or corresponding components. FIG. 10 illustrates the head-of-wall joint in a closed (i.e., relatively upward) position and FIG. 11 illustrates the head-of-wall joint in an open (i.e., relatively downward) position. In the illustrated arrangement, optional fasteners 52 (e.g., 1" concrete fasteners) are shown being used to secure the angles 20 in place. The fasteners 52 pass through both the web of the header track 42 and the horizontal leg 22 of the angle 20.

Preferably, the header track 42 is installed to the concrete slab/ceiling 44 prior to the intumescent deflection angle 20. As described, the angle 20 can have an additional fasteners 52 installed through the header track 42 and leg 22 of the angle 20 to hold it in place or it can be a compression friction fit utilizing interference features 60 (FIG. 4), a small hem 62 (FIG. 5) or the compression on the portion of the intumescent strip 30 that wraps over the corner of the angle 20. FIGS. 10 and 11 illustrate a gap or a space 90 between the outside leg surface of the header track 42 and the inside surface of the vertical leg 24 of the angle 20 at least at an upper end of the leg 24 and, preferably, only at an upper end of the leg 24. This gap 90 has a function and purpose as it allows the head portion of the framing screw 48 to fit between the outside leg surface of the header track 42 and the inside surface of the vertical leg 24 of the angle 20, as shown in FIG. 10. This allows the bottom portion of the angle leg 24 to push up tight against the outside leg surface of the header track 42 without causing damage to the intumescent strip 30 or angle 20 during the cycling of the wall assembly or the movement cycle test of the UL 2079 fire-rated wall joint testing protocol. The angle 20 shown in this figure is bent to approximately an 87 degree angle, but any angle less than 90 degrees will work. The less-than-90-degree angle is what facilitates the creation of the gap 90 in the upper corner between the outside leg of the header track 42 and the inside surface of the vertical leg 24 of the angle 20, while preferably also maintaining contact between the lower end of the vertical leg 24 of the angle 20 and an intermediate portion of the leg of the header track 42. The approximately 45 degree (or other suitable angle) kick-out 34 allows the framing screw 48 to slide up into the gap 90 between the track 42 and the angle 20 and back out again, for an open deflection joint. However, a gap 90 can also be created with a 90 degree angle between the legs 22 and 24 of the angle 20. For example, if a suitable radius is used in the intersection between the horizontal leg 22 and the vertical leg 24, the radius can inhibit or prevent the angle 20 from being placed tightly against the leg of the header track 42 thereby creating a gap 90. However, the illustrated arrangement is preferred because it not only creates a gap 90, but also keeps the lower end of the vertical leg 24 of the angle 20 in contact with the leg of the header track 42.

As described above, FIG. 11 illustrates the head-of-wall assembly 40 in an open position, such as with the deflection gap in a wide open position with an approximately 1¾ inch gap between the upper ends of the wall board 50 and the ceiling 44. The upper edge of the wall board 50 preferably has a tight compression fit against the kick-out 34 to protect against smoke passage within the fire-rated deflection joint. The framing screw 48 is now located below the vertical leg 24 of the angle 20 and at or near the bottom of the slotted header track 42 when the joint is in the open position.

Figure 12:
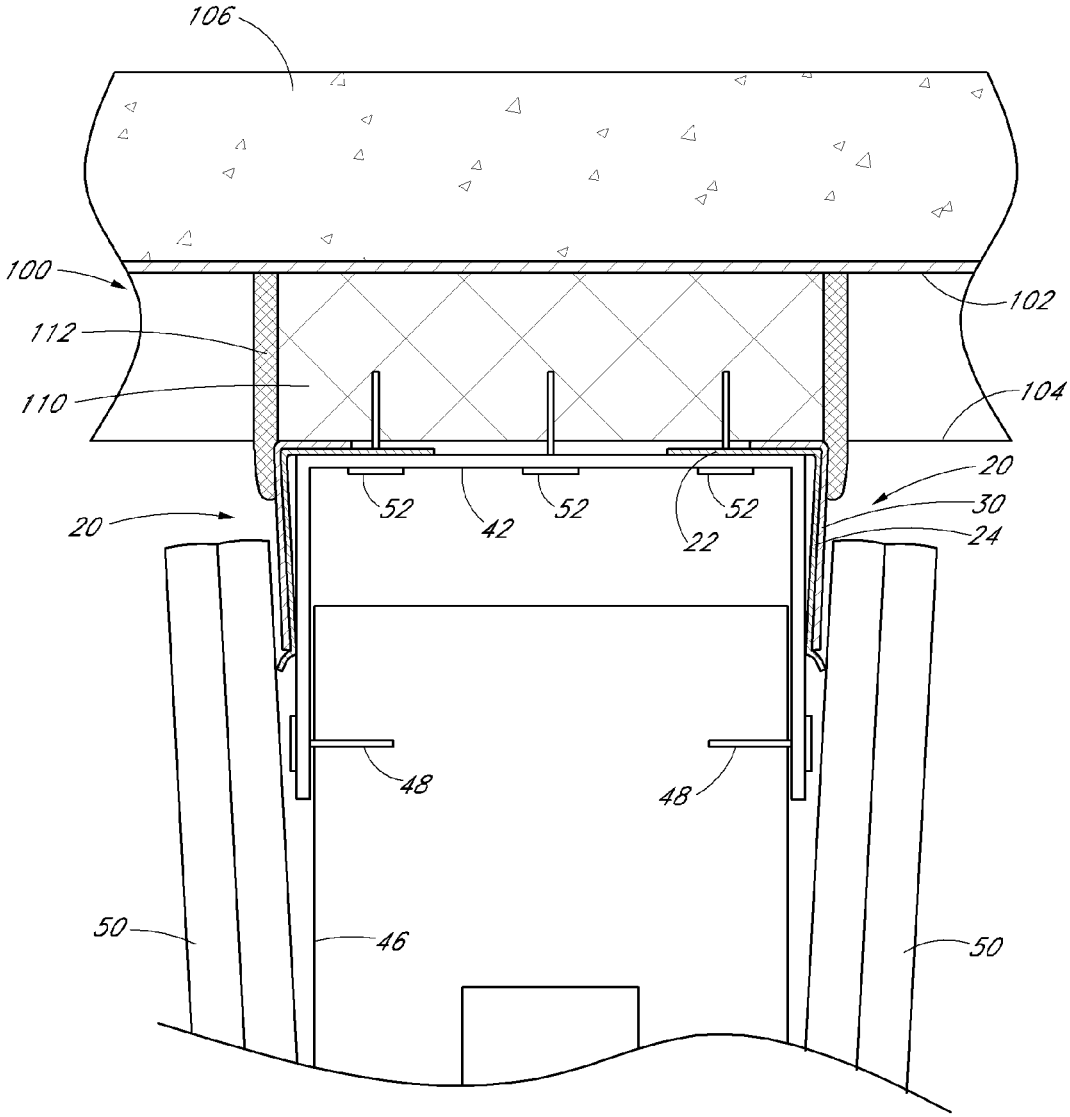
FIG. 12 is a cross-sectional view of a head-of-wall assembly attached to a fluted pan deck ceiling arrangement and including a layer of sprayed elastomeric material.
Figure 13:
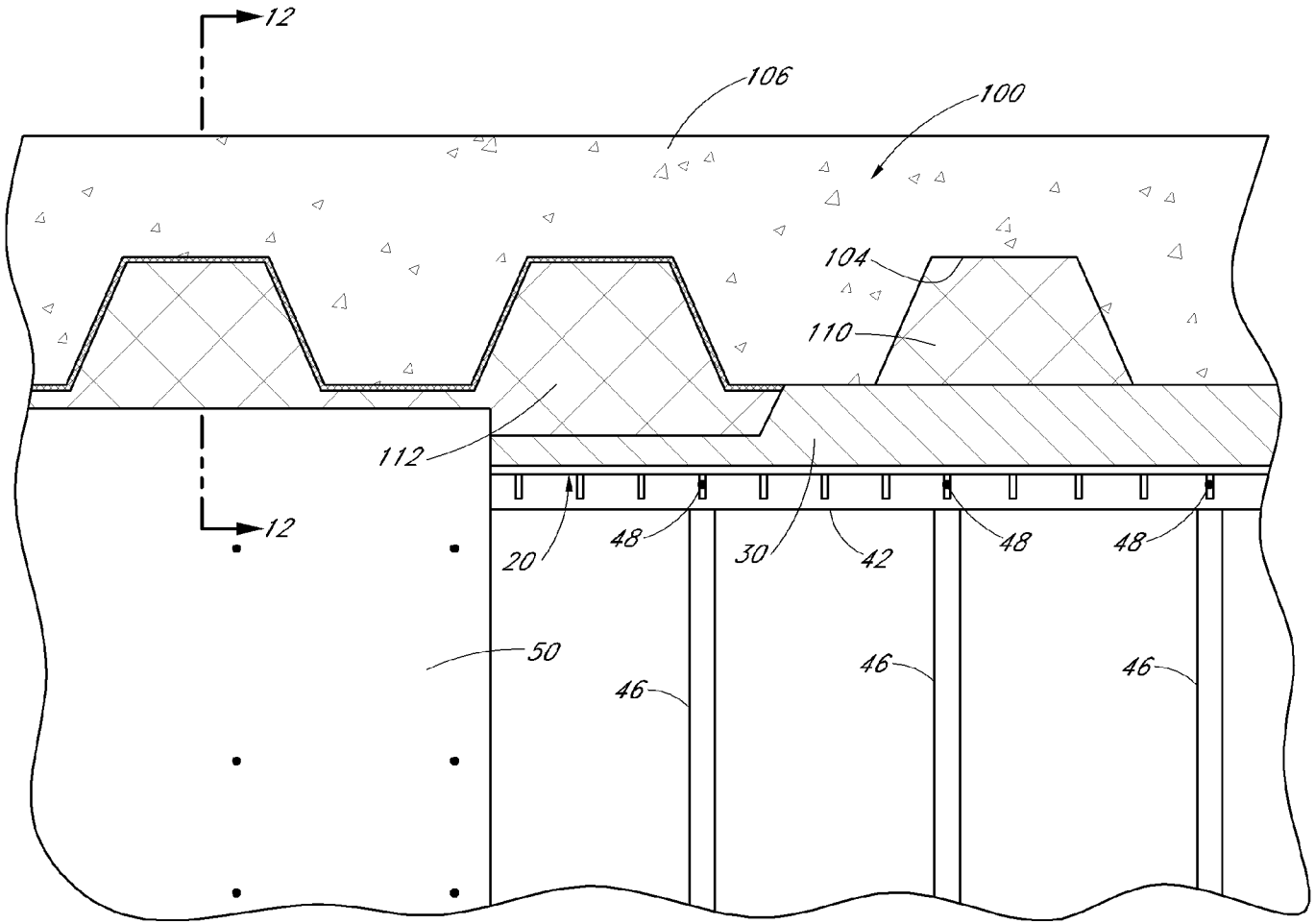
FIG. 13 is an elevation view of the head-of-wall assembly of FIG. 12.

FIGS. 12 and 13 illustrate a wall assembly 40 similar to that shown in and described with reference to FIG. 3 and FIGS. 10 and 11. Accordingly, the same reference numbers are used to describe the same or corresponding components. In FIGS. 12 and 13, a metal stud framed wall assembly 40 is attached to a ceiling 44 in the form of a fluted pan deck 100. The fluted pan deck 100 includes a pan 102, which defines downwardly-opening spaces, voids or flutes 104, and a layer of concrete 106 supported by the pan 102. In the illustrated arrangement, the wall assembly 40 is oriented perpendicular or substantially perpendicular to the flutes 102 of the fluted pan deck 100. Fire-rated walls require fire-resistant material, such as mineral wool 110, to be installed within the voids 104 of the fluted pan deck 100 when the wall assembly 40 is running perpendicular to the flutes 104. The voids or flutes 104 of a fluted pan deck 100 vary in size but generally are about 7½ inches by 3 inches. Mineral wool 110 is compressed and placed into these voids 104. A fire spray material 112 (e.g., a fire-resistant elastomeric material that can be applied with a sprayer) is then sprayed over the top of the mineral wool 110 to protect against smoke passage. The fire spray 112 will generally have elastomeric qualities to it for flexibility and in some cases may even have intumescent qualities. In traditional stuff and spray assemblies, the fire spray 112 will go over the mineral wool 110 and lap over the top edge of the wall board 50, for example, by about ½ inch.

An aspect of the present invention involves the realization that because the fire spray 112 extends over two dissimilar materials, i.e., the mineral wool 110 which is compressible and wall board (e.g., drywall) 50 which is rigid, a great deal of stress is created in the fire spray 112 covering the deflection gap as both materials will act differently as they are cycled up and down. The mineral wool 110 is flexible and will be more forgiving as it cycles, but the drywall 50 is rigid and will pull away from the mineral wool 110 and fire spray 112. Therefore, as these assemblies go through the movement cycle test of UL 2079, the fire spray tends to rip or tear along the joint between the drywall and the mineral wool. Cracks, rips, or tears create a weak spot in the joint and it becomes very vulnerable to the air-leakage test and burn test that follow the movement cycle test according to UL 2079. However, in the arrangement illustrated in FIGS. 12 and 13, it is apparent that the fire spray 112 only laps on the intumescent angle 20. The wall board (e.g., drywall) 50 is able to cycle unencumbered against intumescent angle 20 without stress cracks to the fire rated deflection joint. Such an arrangement is capable of providing a Class III Seismic movement joint according to UL 2079. Traditional stuff and spays typically are only capable of providing Class II Wind Movement according to UL 2079 because these types of joints are very vulnerable to cracking or tearing. FIG. 12 illustrated the wall in a position in which the upper edges of the wall board 50 are below the fire spray 112 and FIG. 13 shows a relatively more upward position of the wall board 50 in which the upper edge of the wall board 50 partially covers the fire spray 112. In FIG. 13, a portion of the wall board 50 and fire spray 112 is removed to show the other components of the wall.

Figure 14:
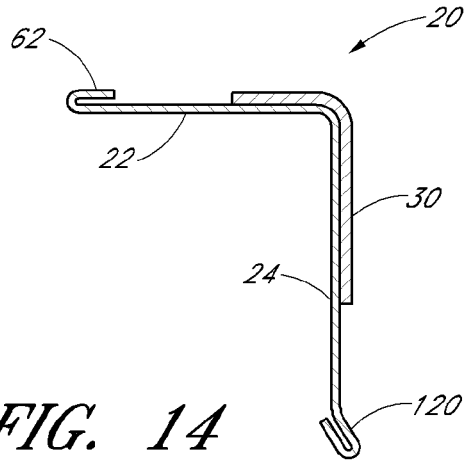
FIG. 14 is a cross-sectional view of an alternative fire-rated angle piece including a hem at the free end of the upper wall portion and a hem at the free end of the side wall portion.

FIG. 14 illustrates another embodiment of a fire-rated angle 20, which is similar to the above-described angles 20. Accordingly, the same reference numbers are used to describe the same or corresponding features. The angle 20 of FIG. 14 includes a locking hem 62 on the upper horizontal leg 22 and another locking hem 120 on the vertical leg 24. The locking hem 62 is similar to the locking hem 62 described in connection with the angle 20 of FIG. 5. In particular, the free end of the locking hem 62 preferably faces toward the vertical leg 24 of the angle 20 to facilitate installation of the angle 20 between the header track 42 and the ceiling 44 (especially when the header track 42 has already been installed) and inhibit or prevent removal of the angle 20 from the installed position. Although the locking hem 62 of the horizontal leg 22 is positioned above the horizontal leg 22 (between the horizontal leg 22 and the ceiling 44), it could also be positioned below the leg 22. However, engagement of the locking hem 62 with the ceiling 44 is believed to provide better resistance to removal of the angle 20 than engagement of the locking hem 62 with the header track 42.

The hem 120 on the vertical leg 24 is just one option for the kick-out 34. The kick-out 34 allows the framing screw 48 to move up and down, under the angle 20 and back out, as described previously. Preferably, the free end of the hem 120 preferably ends prior to the inner surface of the vertical leg 24, or a downward extension or projection of the inner surface, to avoid having the fastener 48 hang up on the free end of the hem 120 as the fastener 48 cycles into and out of the space behind the angle 20. The angle 20 of FIG. 14 also includes a narrower version of the intumescent strip 30 relative to the prior versions shown in FIGS. 1-13. In the illustrated arrangement, the portion of the intumescent strip 30 positioned on the vertical leg 24 ends short of the hem 120. However, preferably, the width of the intumescent strip 30 on the vertical leg 24 is equal to or greater than the width of the strip 30 on the horizontal leg 22. Preferably, the portion of the intumescent strip 30 on the vertical leg 24 covers at least about one-half or at least about two-thirds of the vertical leg 24. In the illustrated arrangement, the intumescent strip 30 covers about two-thirds of the vertical leg 24.

Figure 15:
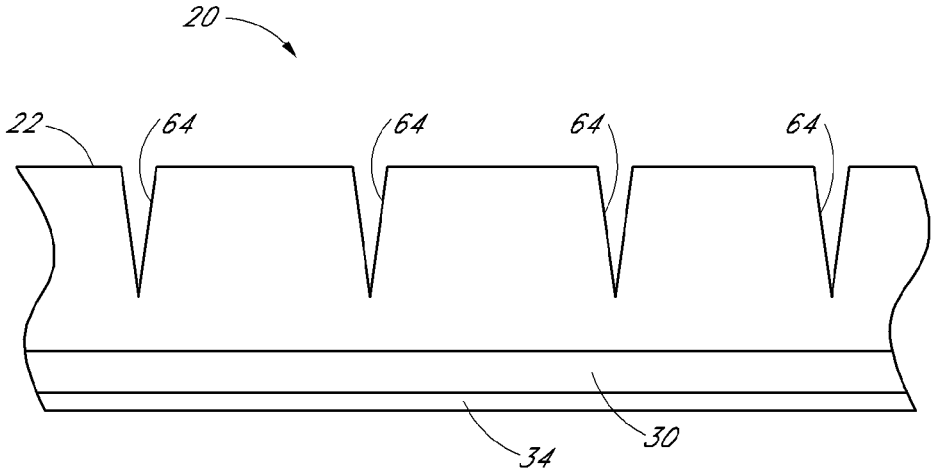
FIG. 15 is a top view of the fire-rated angle piece of FIG. 6.
Figure 16:
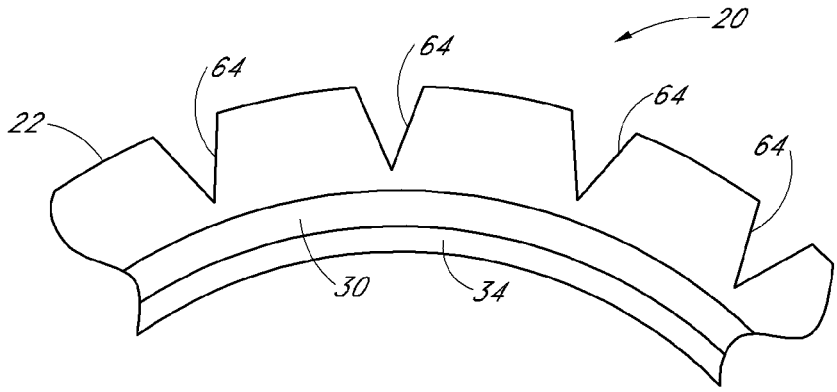
FIG. 16 is a top view of the fire-rated angle piece of FIG. 15 in a bent configuration.

FIGS. 15 and 16 illustrate an angle 20 similar or identical to the angle 20 described with reference to FIG. 6 and which includes multiple slots, cut-outs or notches 64, which are in the form of V-Cuts, extending from the free end of the upper horizontal leg 22 toward the intersection between the horizontal leg 22 and the vertical leg 24. The V-Cuts 64 can vary in spacing and size. A purpose of the V-Cuts 64 is to allow the angle to be used on a radius wall. The V-Cuts 64 allow the angle 20 to be bent inward or outward. FIG. 16 shows the V-cuts 64 in an open position which will happen as the angle 20 is bent. However, advantageously, the intumescent strip 30 will stay intact as the cuts 64 preferably are only on a portion of the upper horizontal attachment leg 22. Thus, the intumescent strip 30 will still protect against fire and smoke passage. The V-Cuts 64 (or other types of slots, cut-outs or notches) may also accommodate/avoid interference with fasteners 52 used to secure the header track 42 to the ceiling 44.

The illustrated angles 20 are intended for use in combination with header tracks 42 that are coupled to an overhead structure 44 and receive upper ends of a plurality of wall studs 46. However, the angles 20 can also be used with other types of tracks or other structural components to create a fire-rated joint. For example, the angles 20 could be used with a bottom track or a wall stud. Although not shown herein, as is known, a stud wall commonly includes a bottom track (which may be the same as or similar to the illustrated header tracks 42) that receives the bottom ends of the wall studs 46 and is secured to the floor. With respect to the disclosed header tracks 42, these can be of a solid leg variety or can be slotted header tracks, in which each of the first side flange and the second side flange includes a plurality of elongated slots that extend in a vertical direction, or in a direction from a free end of the flange toward the web and perpendicular to a length direction of the track. The centerlines of adjacent slots are spaced from one another along a length of the track by a distance, such as one inch, in one embodiment. However, other offset distances could be provided, depending on the desired application. Preferably, the slots are linear in shape and sized to receive and guide a fastener (e.g., fastener 48) that couples a stud to the header track. The slots allow relative movement between the header track and the studs. The linear shape of the slots constrains the fasteners to substantially vertical movement.

As discussed, preferably, the free end of the side flange of the angles forms a kick-out (e.g., kick-out 34). The kick-out extends outwardly from the remainder of the side flange in a direction away from the top flange (and away from the header track when assembled). One type of kick-out is an outwardly-bent end portion of the side flange which is oriented at an oblique angle relative to the remaining, preferably planar, portion of the side flange. As described herein, the use of the term side flange (vertical leg or wall portion) can include the kick-out or, in some contexts, can refer to the portion of the side flange excluding the kick-out. As described herein, the kick-out functions as a lead-in surface for the fasteners that pass through the slots of the header track when the heads of the fasteners move toward the top of the slots and in between the side flange of the angle and the flange of the header track. However, the kick-out can be otherwise shaped if desired, depending on the intended application and/or desired functionality. For example, the kick-out can be configured to contact the wallboard of an associated wall assembly to assist in creating a seal between the angle and the wallboard or to inhibit damage to the fire-resistant material on the angle, as described. Preferred kick-outs can satisfy one or more of these functions. In one arrangement, the kick-out extends outwardly less than about ¼ inch, less than about ⅛ inch or less than about 1/16 inch.

The illustrated angles are fire-rated components and include a fire-resistant material arranged to seal the head-of-wall gap at which the angle is installed. Preferably, the fire-resistant material is an intumescent material strip, such as an adhesive intumescent tape. The intumescent strip is made with a material that expands in response to elevated heat or fire to create a fire-blocking char. The kick-out can extend outwardly a distance greater than the thickness of the intumescent strip, a distance approximately equal to the thickness of the intumescent strip, or a distance less than the thickness of the intumescent strip. The size of the kick-out can be selected based on whether it is desirable for the wall board material to contact the kick-out (e.g., to create a seal or protect the intumescent strip), the intumescent strip, or both the kick-out and the intumescent strip.

The intumescent strip preferably is positioned on one or both of the side flange and the top flange. Thus, one embodiment of an angle includes an intumescent strip only on the top flange and another embodiment of an angle includes an intumescent strip only on the side flange. However, in the illustrated arrangements, the intumescent strip is attached on both the side flange and the top flange of the angle. Preferably, the intumescent strip covers a substantial entirety of the side flange and also extends beyond the top flange. That is, the intumescent strip preferably extends from the kick-out of the side flange to the top flange and beyond the top flange. Such an arrangement permits the intumescent strip to contact the ceiling or other overhead support structure to create an air seal at the head-of-wall. Preferably, the upper edge of the intumescent strip wraps around the corner of the angle and is attached to the top flange. Such an arrangement causes the intumescent strip to be pinched between the angle and the ceiling or other overhead support structure to assist in keeping the intumescent strip in place when exposed to elevated heat, which may cause failure of an adhesive that secures the intumescent strip to the angle, as described above. However, although less preferred, the upper edge of the intumescent strip could simply extend beyond (above, in the illustrated arrangement) the top flange without being attached to the top flange.

Preferably, a relatively small amount of the intumescent strip is positioned on the top flange relative to the amount positioned on the side flange. For example, the intumescent strip has a width, which in cross-section can be viewed as a length. Preferably, a length of the intumescent strip on the side flange is at least about 3 times the length of the intumescent strip on the top flange. In one arrangement, the length of the intumescent strip on the side flange is at least about 5 times the length of the intumescent strip on the top flange. In another arrangement, the length of the intumescent strip on the side flange is at least about 10 times the length of the intumescent strip on the top flange. Preferably, the length of the intumescent strip on the side flange is between about ½ inches and 1½ inches and the length of the intumescent strip on the top flange is between about ⅛ inches and ½ inches. In one preferred arrangement, the length of the intumescent strip on the side flange is about ¾ inches and the length of the intumescent strip on the top flange is about ¼ inches.

In the illustrated arrangements, the side flange of the angle is shorter than the flanges of the header track. The side flange of the angle can cover an upper portion of the slots of the header track. Preferably, at least a lower portion of the slots are exposed or left uncovered by the side flange of the angle. In one arrangement, the length of the side flange of the angle is about one-half of the length of the flanges of the header track. The side flange of the angle can have a length of between about ¾ inches and 3 inches, or between about 1 and 2 inches. In one arrangement, the side flange of the angle has a length of about 1½ inches or 1¼ inches. The flanges of the header track can be any suitable length. For example, the flanges can be between about 2 and 4 inches in length, with specific lengths of about 2½ inches, 3 inches, 3¼ inches and 3½ inches, among others.

The web of the header track can be any suitable width. For example, the web can have a width between about 2½ and 10 inches, with specific lengths of about 3.5 inches, 4 inches, 5.5 inches, 6 inches and 7.5 inches, among others. Preferably, the top flange of the angle is not wider than the web of the header track and, more preferably, is less than about ½ the width of the header track. If desired, a thermal break material can be positioned between any or all corresponding surfaces of the angle and the header track. The thermal break material can be applied to the inner surfaces of the angle. The thermal break material can be a liquid applied material, or an adhesively applied sheet membrane material to provide thermal break insulation to slow down heat passage during a fire. Any suitable insulating materials can be used.

The header track and the angle can be constructed of any suitable material by any suitable manufacturing process. For example, the header track and angle can be constructed from a rigid, deformable sheet of material, such as a galvanized light-gauge steel. However, other suitable materials can also be used. The header track and the angle can be formed by a roll-forming process. However, other suitable processes, such as bending (e.g., with a press brake machine), can also be used. Alternatively, the angle could be made from an extruded piece of material. Preferably, the intumescent strip is applied during the manufacturing process. However, in some applications, the intumescent strip could be applied after manufacturing (e.g., at the worksite).

As is known, in the wall assembly, one or more pieces of wallboard are attached to one or both sides of the studs by a plurality of suitable fasteners, such as drywall screws. Preferably, the uppermost drywall screws are positioned close to the header track but spaced sufficiently therefrom so as to not inhibit complete upward movement of the studs relative to the header track.

Preferably, in a neutral or unloaded condition, the heads of the fasteners securing the studs to the header track are positioned below the lowermost ends, or free ends, of the side flanges of the angle. Preferably, in such a position, an upper end of the wallboard rests against the intumescent strip and/or the kick-out. When the wall is deflected such that the studs move upwardly towards or to a closed position of the deflection gap, the heads of the fasteners may enter in between the flanges of the header track and the side flanges of the angles. If the gap between the flanges is less than the width of the head of the fastener, the side flanges of the angle may flex or deflect outwardly to accommodate the heads of the fasteners. The shape and/or angle of the kick-out can facilitate the entry of the heads of the fasteners in between the flanges without getting hung up on the flanges.

The above-described arrangements can also be utilized at a gap at the bottom of the wall assembly and at a gap at the side of the wall assembly. Preferably, each such assembly is similar to the head-of-wall assemblies described above. In particular, preferably, each such assembly creates a fire-resistant structure at the respective wall gap.

The described assemblies provide convenient and adaptable fire block structures for a variety of linear wall gap applications, which in at least some embodiments permit the creation of a fire rated joint according to UL 2079. The separate angles include fire-retardant materials (e.g., intumescent material strips) secured (e.g., adhesively attached or bonded) to appropriate locations on the angles and can be used with a variety of headers, footers (bottom tracks or sill plates) and studs to create a customizable assembly. Thus, one particular type of angle can be combined with multiple sizes or types of base tracks, headers, sill plates or studs to result a large number of possible combinations. The angles can be configured for use with commonly-available tracks, headers, sill plates or studs, in addition to customized tracks, headers, sill plates or studs specifically designed for use with the angles. Thus, the advantages of the described systems can be applied to existing wall assemblies. Therefore, the angles can be stocked in bulk and used as needed with an appropriate framing component.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present angle piece and assemblies have been described in the context of particularly preferred embodiments, the skilled artisan will appreciate, in view of the present disclosure, that certain advantages, features and aspects of the angle piece and assemblies may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A fire-rated assembly for a linear wall gap, comprising:

a track that has a web, a first flange and a second flange, wherein the web is substantially planar and has a first side edge and a second side edge, the first flange and the second flange extend in the same direction from the first and second side edges, respectively, wherein each of the first and second flanges is substantially planar such that the track defines a substantially U-shaped cross section;

an angle that has a first flange and a second flange, wherein each of the first flange and the second flange is substantially planar such that the angle defines a substantially L-shaped cross section, each of the first and second flanges has a free end opposite a corner of the angle;

a heat-expandable intumescent strip attached to the angle and extending lengthwise along an outer surface of the second flange, the intumescent strip comprising a portion that extends past an outer surface of the first flange of the angle;

wherein the first flange of the angle is positioned between the web of the track and an overhead structure with the second flange of the angle being positioned adjacent one of the first or second flanges of the track with at least a portion of the second flange contacting the one of the first or second flanges of the track.

2. The assembly of claim 1, wherein the free end of the second flange defines a kick-out portion that extends in a direction opposite the first flange.

3. The assembly of claim 2, wherein the free end of the first flange defines a locking hem configured to inhibit or prevent removal of the angle from an installed position between the track and the overhead structure.

4. The assembly of claim 1, wherein the free end of the first flange defines a locking hem configured to inhibit or prevent removal of the angle from an installed position between the track and the overhead structure.

5. The assembly of claim 1, wherein an angle defined between the first flange and the second flange of the angle is less than 90 degrees such that a gap is created between an upper end of the second flange of the angle and an upper end of the one of the first and second flanges of the track.

6. The assembly of claim 5, wherein the angle is approximately 87 degrees.

7. The assembly of claim 1, wherein the first flange of the angle defines a plurality of V-shaped cut-outs extending from the free edge toward the corner.

8. The assembly of claim 1, wherein the intumescent strip extends along and is attached to a portion of the first flange of the angle such than the portion contacts the overhead structure when the fire-rated assembly is assembled to the overhead structure.

9. The assembly of claim 8, wherein the intumescent strip defines a total length in a cross-sectional direction, wherein a portion of the total length located on the second flange is at least three times greater than a portion of the total length on the first flange.

10. The assembly of claim 8, wherein the intumescent strip covers a substantial entirety of the outer surface of the second flange.

11. The assembly of claim 1, wherein the one of the first and second flange of the track is longer than the second flanges of the angle.

12. The assembly of claim 11, wherein one of the first and second flange of the track is at least about twice as long as the second flange of the angle.

13. The assembly of claim 1, further comprising a plurality of slots on the first and second flanges of the track, wherein the slots extend in a direction perpendicular to a length of the first track.

14. The assembly of claim 1, wherein the track is a footer or header track.

15. The assembly of claim 1, wherein the track is a stud framing member made from wood or metal.

16. The assembly of claim 1, further comprising a plurality of studs and a wall board, wherein an upper end of each of the studs is received within and secured to the track and the wall board is secured to the plurality of studs, wherein the second flange of the angle is positioned between the wall board and the one of the first and second flanges of the track.

17. A method of assembling a fire-rated wall joint, comprising:

securing a header track to a ceiling;

positioning a horizontal leg of an elongated, generally L-shaped fire-rated angle piece between the header track and the ceiling such that at least a portion of an intumescent material strip located on a vertical leg of the angle piece faces away from the header track;

positioning upper ends of a plurality of studs into the header track;

securing at least one wall board member to the plurality of studs such that the vertical leg of the angle piece is positioned between the at least one wall board member and the header track.

18. The method of claim 17, wherein the positioning of the horizontal leg between the header track and the ceiling is done after the securing of the header track to the ceiling.

* * * * *